US008646480B2

(12) United States Patent
Koyama et al.

(10) Patent No.: US 8,646,480 B2
(45) Date of Patent: Feb. 11, 2014

(54) FUEL SUPPLY APPARATUS

(75) Inventors: Shinya Koyama, Wako (JP); Kyohei Hosoya, Wako (JP); Kuniharu Kimura, Wako (JP); Junji Miyazaki, Wako (JP); Hikaru Tsukamoto, Wako (JP); Toshihiko Naito, Shioya-gun (JP)

(73) Assignees: Honda Motor Co., Ltd., Tokyo (JP); Keihin Corporation, Tokyo (JP)

( * ) Notice: Subject to any disclaimer, the term of this patent is extended or adjusted under 35 U.S.C. 154(b) by 344 days.

(21) Appl. No.: 13/169,404

(22) Filed: Jun. 27, 2011

(65) Prior Publication Data

US 2011/0315254 A1 Dec. 29, 2011

(30) Foreign Application Priority Data

Jun. 29, 2010 (JP) ..... 2010-148166

(51) Int. Cl.
*F02M 37/10* (2006.01)

(52) U.S. Cl.
USPC ..... 137/565.17; 123/509

(58) Field of Classification Search
USPC ..... 137/565.17, 565.34; 123/509; 280/834, 280/835
See application file for complete search history.

(56) References Cited

U.S. PATENT DOCUMENTS

| | | | | | |
|---|---|---|---|---|---|
| 6,129,074 | A * | 10/2000 | Frank | 123/509 |
| 6,158,461 | A * | 12/2000 | Frank et al. | 123/509 |
| 6,216,671 | B1 * | 4/2001 | Sawert et al. | 123/509 |
| 6,308,691 | B1 * | 10/2001 | Frank et al. | 123/509 |
| 6,412,517 | B1 * | 7/2002 | Flambert et al. | 137/565.34 |
| 7,472,693 | B2 * | 1/2009 | Izutani et al. | 123/509 |
| 8,151,768 | B2 * | 4/2012 | Kaneda et al. | 123/509 |
| 8,297,260 | B2 * | 10/2012 | Masuda | 123/509 |
| 2004/0000344 | A1 * | 1/2004 | Okabe et al. | 123/509 |
| 2008/0216801 | A1 * | 9/2008 | Kanamaru et al. | 123/509 |
| 2009/0242300 | A1 * | 10/2009 | Mizukura et al. | 123/509 |

FOREIGN PATENT DOCUMENTS

| | | |
|---|---|---|
| JP | 2007-118886 A | 5/2007 |
| JP | 2009-221894 A | 10/2009 |

* cited by examiner

*Primary Examiner* — John Rivell
(74) *Attorney, Agent, or Firm* — Birch, Stewart, Kolasch & Birch, LLP

(57) ABSTRACT

A fuel supply apparatus or fuel pump unit includes a lower case having a flange plate fixed to a fuel tank and upstanding walls extending into the fuel tank. An upper case housing a fuel pump therein is provided that includes brackets disposed along inner sides of the upstanding walls. The upstanding walls having engaging holes defined therein, and the brackets having attachment members engaging in the engaging holes. The brackets include tongues projecting heightwise beyond the upstanding walls.

12 Claims, 8 Drawing Sheets

FUEL SUPPLY APPARATUS

CROSS-REFERENCE TO RELATED APPLICATIONS

The present application claims priority under 35 USC 119 to Japanese Patent Application No. 2010-148166 filed on Jun. 29, 2010 the entire contents of which are hereby incorporated by reference.

BACKGROUND OF THE INVENTION

1. Field of the Invention

The present invention relates to a fuel supply apparatus for use with a fuel tank.

2. Description of Background Art

Heretofore, a known fuel supply apparatus for use with a fuel tank includes a lower case fixed to the bottom of the fuel tank and an upper case housing a fuel pump and coupled to the lower case. See, for example, Japanese Patent Laid-Open No. 2007-118886. According to Japanese Patent Laid-Open No. 2007-118886, the lower case has a plate-like flange fixed to the fuel tank and an upstanding wall extending into the fuel tank and integral with the plate-like flange. The upper case has a bracket corresponding to the upstanding wall. The upper case is coupled to the lower case by an attachment member disposed on the bracket and engaging in an engaging hole defined in the upstanding wall of the upper case.

With the above conventional fuel supply apparatus, however, since the upstanding wall and the bracket have substantially the same heights while the upper case is being coupled to the lower case, if the upper case and the lower case have to be disassembled for maintenance or the like, it is necessary to insert a tool such as a screwdriver between the upstanding wall and the bracket to disengage the attachment member from the engaging hole. Therefore, it would be difficult to manually disengage the attachment member from the engaging hole without any tools, thus posing maintenance problems.

SUMMARY AND OBJECTS OF THE INVENTION

The present invention has been made in view of the above problems. It is an object of an embodiment of the present invention to provide a fuel supply apparatus with increased maintainability.

To achieve the above object according to an embodiment of the present invention, a fuel supply apparatus includes a lower case (61) having a plate (65) fixed to a fuel tank (13) and upstanding walls (66A, 66B, 66C) extending into the fuel tank (13), and an upper case (81) housing a fuel pump (82) therein and having brackets (87A, 87B, 87C) disposed along inner sides of the upstanding walls (66A, 66B, 66C), the upstanding walls (66A, 66B, 66C) having engaging holes (75A, 75B, 75C) defined therein, and the brackets (87A, 87B, 87C) having attachment members (91A, 91B, 91C) engaging in the engaging holes (75A, 75B, 75C), wherein the brackets (87A, 87B, 87C) have tongues (92A, 92B, 92C) projecting heightwise beyond the upstanding walls (66A, 66B, 66C).

According to the above arrangement, since the brackets of the upper case have the tongues which project heightwise beyond the upstanding walls of the lower case, the brackets disposed along the inner sides of the upstanding wall can easily be deformed inwardly by pressing the tongues, and hence the attachment members are caused to disengage from the engaging holes. Consequently, the attachment members can disengage from the engaging holes simply by pressing the tongues inwardly without the need for a tool such as a screwdriver or the like, so that the maintainability of the fuel pump apparatus is increased.

In the above arrangement, the brackets (87A, 87B, 87C) and the upstanding walls (66A, 66B, 66C) may be disposed concentrically with each other, and the attachment members (91A, 91B, 91C) and the tongues (92A, 92B, 92C) may be circumferentially offset with respect to each other.

Since the attachment members and the tongues are circumferentially offset with respect to each other, and large distances are maintained between the attachment members and the tongues, the tongues can be pressed a large stroke, allowing the attachment members to disengage easily from the engaging holes. Therefore, the maintainability of the fuel pump apparatus is increased.

Furthermore, a filter (90) may be disposed within the brackets (87A, 87B, 87C) perpendicularly to the plate (65), and at least one of the tongues (92A, 92B, 92C) may be disposed in confronting relation to the filter (90).

As a large distance is kept between the brackets and the filter, when the tongues are pressed, the brackets are deformed a large stroke, allowing the attachment members to disengage easily from the engaging holes. Therefore, the maintainability of the fuel pump apparatus is increased.

The tongues (92A, 92B, 92C) may be disposed on circumferential ends of the brackets (87A, 87B, 87C).

As the tongues are disposed on the circumferential ends of the brackets, and hence there are no irregularities in the boundaries between the tongues and the brackets, the lower case and the upper case can be assembled and disassembled easily and efficiently.

The engaging holes (75A, 75B, 75C) may include three engaging holes spaced at substantially equal intervals.

Since the three engaging holes are spaced at equal intervals, the engaging holes are well balanced in position, and the lower case and the upper case can be assembled and disassembled easily and efficiently.

With the fuel supply apparatus according to an embodiment of the present invention, the brackets can easily be deformed inwardly by pressing the tongues of the brackets of the upper case. Thus, the attachment members are caused to disengage from the engaging holes. Consequently, the attachment members can disengage from the engaging holes simply by pressing the tongues inwardly without the need for a tool such as a screwdriver or the like, so that the maintainability of the fuel pump apparatus is increased.

Since the attachment members and the tongues are circumferentially offset with respect to each other, and large distances are maintained between the attachment members and the tongues, the tongues can be pressed a large stroke, allowing the attachment members to disengage easily from the engaging holes. Therefore, the maintainability of the fuel pump apparatus is increased.

As a large distance is kept between the brackets and the filter, when the tongues are pressed, the brackets are deformed a large stroke, allowing the attachment members to disengage easily from the engaging holes. Therefore, the maintainability of the fuel pump apparatus is increased.

As the tongues are disposed on the circumferential ends of the brackets, and hence there are no irregularities in the boundaries between the tongues and the brackets, the lower case and the upper case can be assembled and disassembled easily and efficiently.

Since the three engaging holes are spaced at equal intervals, the engaging holes are well balanced in position, and the lower case and the upper case can be assembled and disassembled easily and efficiently.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A fuel supply apparatus according to an embodiment of the present invention will be described below with reference to the drawings.

Figure 1:
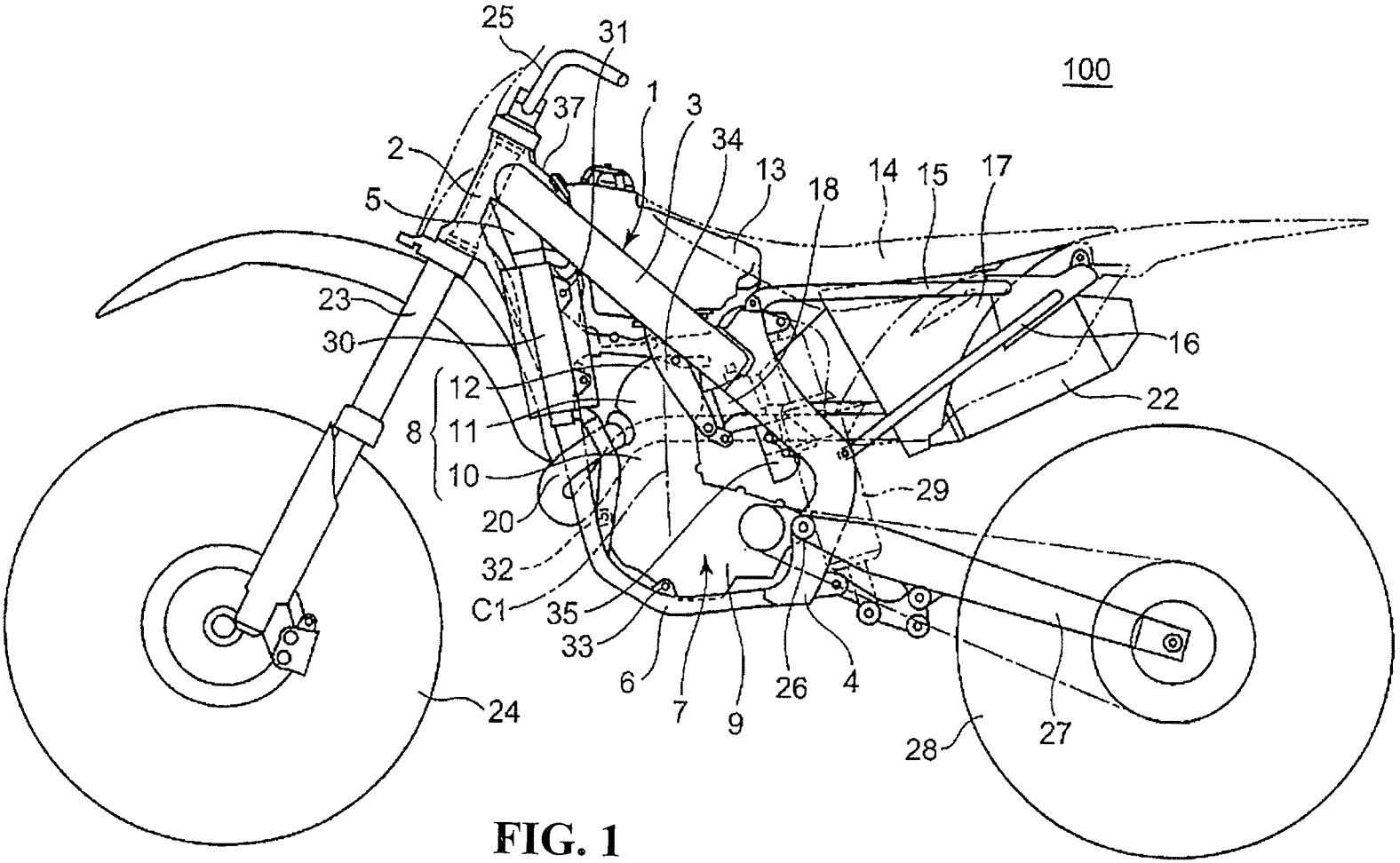
FIG. 1 is a left side elevational view of an off-road motorcycle incorporating a fuel supply apparatus according to an embodiment of the present invention.

FIG. 1 is a left side elevational view of an off-road motorcycle incorporating a fuel supply apparatus according to an embodiment of the present invention.

A motorcycle 100 including a motorcycle body frame 1 having a head pipe 2, a main frame 3, a central frame 4, a down frame 5, and a lower frame 6 which are joined together into a loop structure with an engine 7 supported therein. The engine 7 includes cylinders 8 and a crankcase 9. Each of the main frame 3, the central frame 4, and the lower frame 6 is provided as a pair of left and right members. Each of the head pipe 2 and the down frame 5 is provided as a single member along the center of the motorcycle body.

The main frame 3 is of a straight shape extending rearwardly downwardly above the engine 7 and joined to an upper end of the central frame 4 which extends vertically behind the engine 7. The down frame 5 extends downwardly in front of the engine 7 and has a lower end joined to a front end of the lower frame 6. The lower frame 6 is bent from a front lower portion of the engine 7 to a position beneath the engine 7, then extends substantially straight rearwardly, and has a rear end joined to a lower end of the central frame 4.

A fuel tank 13 is disposed above the engine 7 and is supported on the main frame 3. A seat 14 is disposed behind the fuel tank 13 and is supported on a seat rail 15 which extends rearwardly from an upper end of the central frame 4. A rear frame 16 is disposed beneath the seat rail 15. An air cleaner 17 is supported by the seat rail 15 and the rear frame 16. The air cleaner 17 purifies air and supplies it through a throttle body 18 to a cylinder head 11 from behind the motorcycle body.

The engine 7 is a water-cooled four-cycle engine with the cylinders 8 being disposed forwardly of the crankcase 9 in an erected state each having a substantially vertical axis C1. The engine 7 includes a cylinder block 10, a cylinder head 11, and a head cover 12 which are arranged successively upwardly in the order named.

An exhaust pipe 20, which is disposed forwardly of the cylinders 8, extends from front portions of the cylinders 8 forwardly of the crankcase 9, bends to the right, and extends rearwardly on the right side of the motorcycle body. A muffler 22 is connected to a rear end of the exhaust pipe 20.

A front fork 23 is supported by the head pipe 2 and supports on a lower end thereof a front wheel 24 that is steered by a handle 25. A rear arm 27 is swingably supported on the central frame 4 by a pivot shaft 26. A rear wheel 28 is supported on a rear end of the rear arm 27, and is driven by the engine 7 through a chain. A rear suspension includes a shock absorber 29 disposed between the rear arm 27 and an upper portion of the central frame 4.

In FIG. 1, a radiator 30 is provided that is supported by a rubber mount 31. In addition, engine mounts 32, 33, an engine hanger 34, and an electric accessory case 35 are provided. The engine 7 is also supported on the central frame 4 by the pivot shaft 26.

Figure 2:
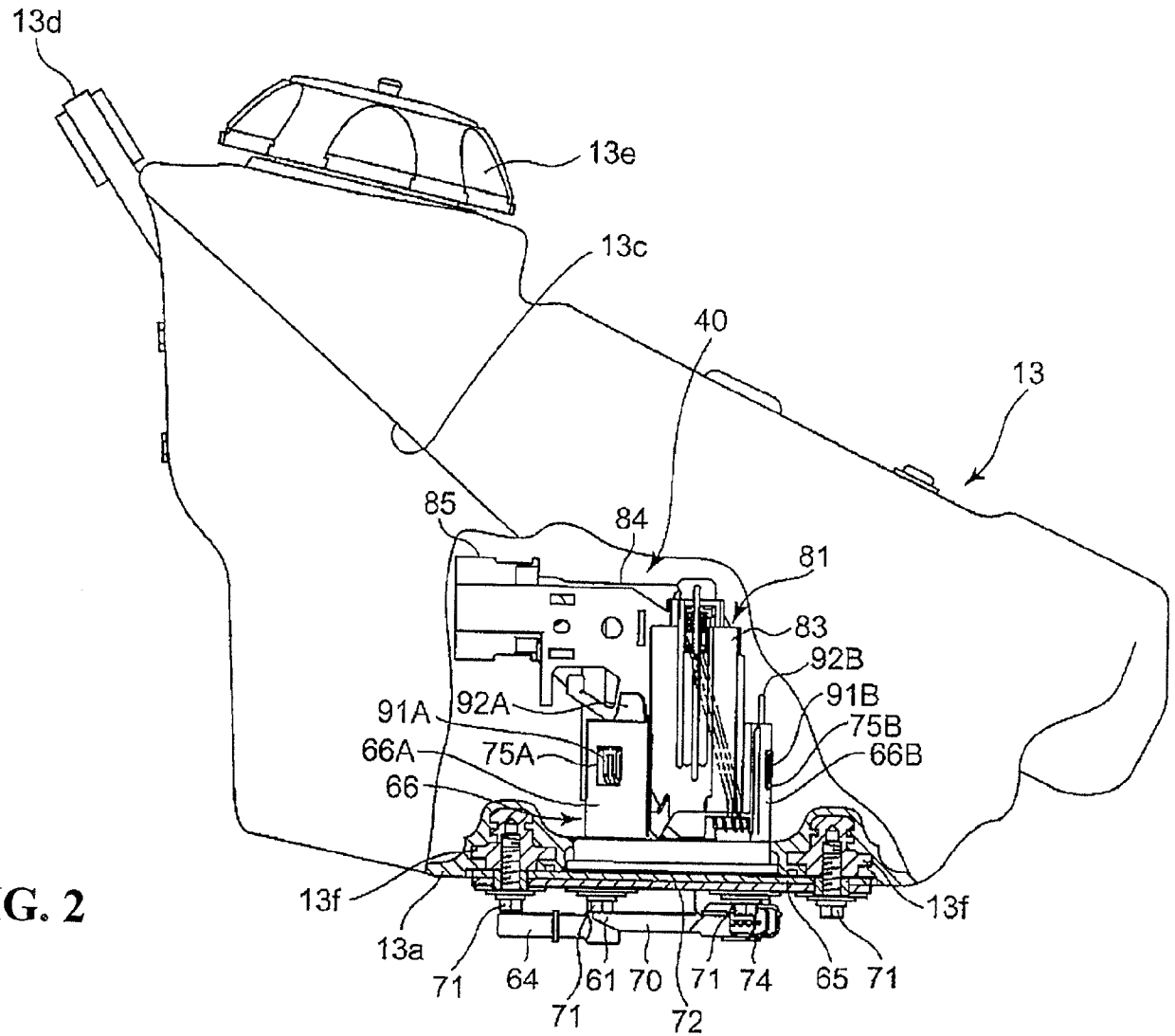
FIG. 2 is a left side elevational view, partly cut away, of a fuel tank.

FIG. 2 is a left side elevational view, partly cut away, of the fuel tank 13.

As shown in FIG. 2, the fuel tank 13 is of a relatively small size and is in the shape of a substantially rectangular triangle having a front lower right-angle corner in side elevation with an upper surface provided as a slanted surface extending obliquely rearwardly and downwardly. The fuel tank 13 is disposed above the engine 7 and has a lower portion sandwiched between the left and right members of the main frame 3. The fuel tank 13 includes steps 13*c* on both front sides thereof which ride on upper surfaces of the main frame 3. A mounting bracket 13*d* is disposed on a front portion of the fuel tank 13. The mounting bracket 13*d* is bolted to a gusset 37 (see FIG. 1) mounted on a rear portion of the head pipe 2. A tank cap 13*e* by which a fuel filler neck is openably closed is mounted on an upper portion of the fuel tank 13. The fuel tank 13 has fastening members 13*f* on a bottom 13*a* thereof to which a fuel pump unit 40 (fuel supply apparatus) to be described later is fastened.

The fuel pump unit 40 which pressure-feeds a fuel to the engine 7 is housed in the fuel tank 13.

The fuel pump unit 40 is disposed directly above the cylinders 8. In the illustrated embodiment, the fuel pump unit 40 is positioned in overlapping relation to an extension of the axis C1 (see FIG. 1) of the cylinders 8. Although the fuel pump unit 40 should preferably be disposed in overlapping relation partly to the axis C1, it may be positioned above the engine 7. With this arrangement, fuel pump unit 40 which is heavy can be disposed in the vicinity of the center of gravity of the engine 7 in the longitudinal direction of the motorcycle body.

The fuel pump unit 40 is inserted into the fuel tank 13 through an opening defined in the bottom 13*a* thereof. A joint pipe 64 which projects forwardly of the motorcycle is mounted on the bottom of the fuel pump unit 40. A supply pipe (not shown) for supplying the fuel to the engine 7 is connected to the joint pipe 64, and has a distal end connected to an injector (not shown) mounted on the throttle body 18.

Figure 3:
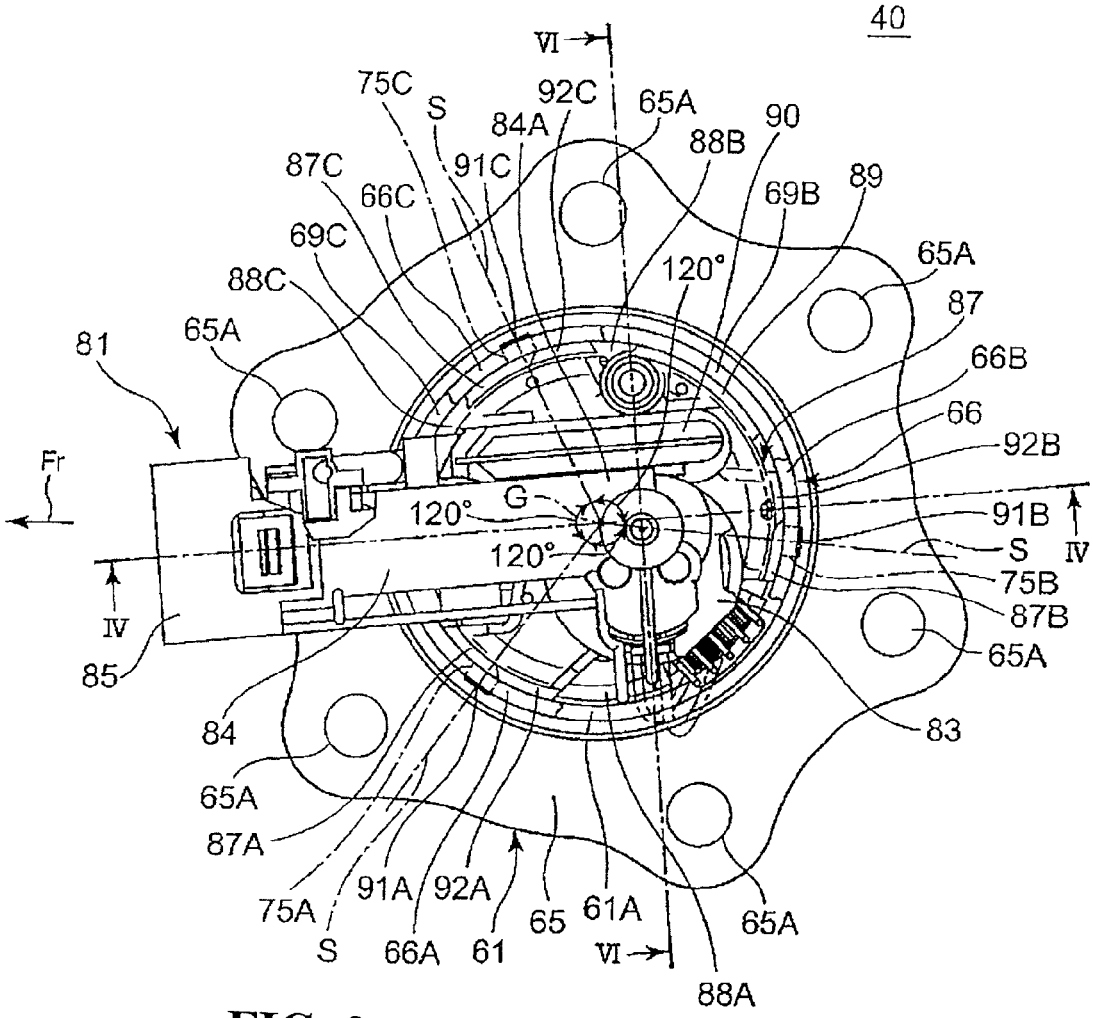
FIG. 3 is a plan view of a fuel pump unit.
Figure 4:
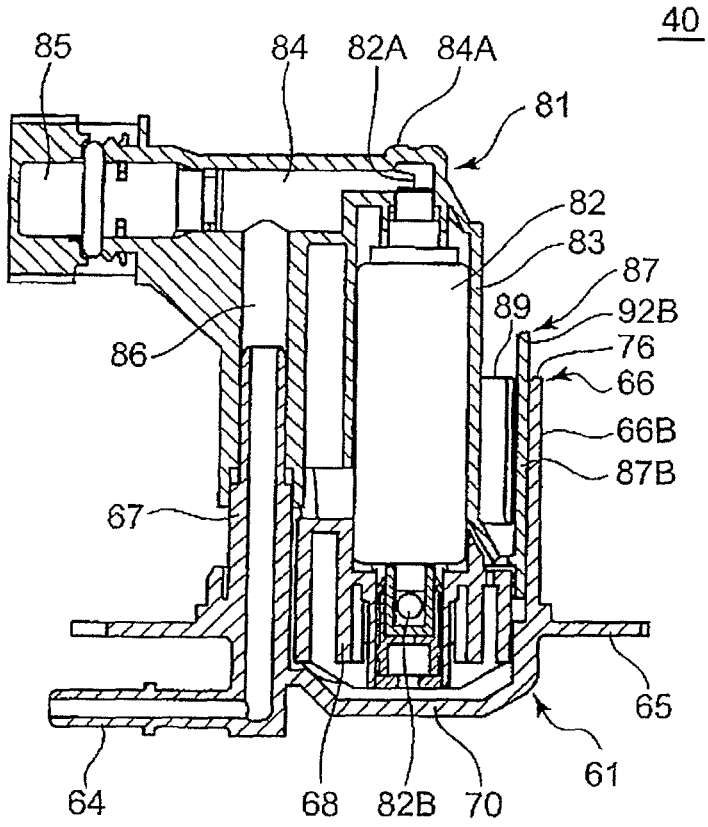
FIG. 4 is a cross-sectional view taken along line IV-IV of FIG. 3.

FIG. 3 is a plan view of the fuel pump unit 40 and FIG. 4 is a cross-sectional view taken along line IV-IV of FIG. 3. In FIG. 3, the arrow Fr points in the forward direction of the motorcycle.

As shown in FIGS. 2 through 4, the fuel pump unit 40 includes a lower case 61 fixed to the bottom 13*a* of the fuel tank 13, an upper case 81 disposed in the fuel tank 13 and detachably mounted on the lower case 61, and a pump 82 (fuel pump) housed in the upper case 81. Each of the lower case 61 and the upper case 81 is made of resin and is integrally molded of resin.

The lower case 61 has an annular flange plate 65 (plate) connected to the bottom 13*a* of the fuel tank 13, a downwardly concave reservoir 70 defined in an inner surface of the flange plate 65, an upstanding wall 66 erected on an inner peripheral edge of the flange plate 65, the joint pipe 64, a connection channel 67 connected to the joint pipe 64, and a connector 74 (see FIG. 2) to which wires for energizing the fuel pump unit 40 are connected.

The flange plate 65 is of a substantially hexagonal outer peripheral shape in plan as shown in FIG. 3, and has attachment holes 65A defined in the respective vertex lobes of the hexagonal outer peripheral shape. As shown in FIG. 2, the lower case 61 is fastened to the fastening members 13*f* on the bottom 13*a* by bolts 71 inserted through the attachment holes 65A in the flange plate 65 which is held against the bottom 13*a* from below. A ring-shaped retaining plate 72 is interposed between the flange plate 65 and the bolts 71.

The reservoir 70 has a bottom surface positioned below the flange plate 65. The reservoir 70 stores the fuel therein.

The upstanding wall 66 includes three upstanding walls 66A, 66B, 66C spaced at substantially equal intervals along the inner peripheral edge of the flange plate 65. The upstanding walls 66A, 66B, 66C are arranged in a circular pattern as viewed in plan. The upstanding wall 66 extends substantially perpendicularly to the flange plate 65 into the fuel tank 13. As shown in FIG. 3, the upstanding wall 66 has recesses 69A, 69B, 69C defined circumferentially between the upstanding walls 66A, 66B, 66C.

The upper case 81 has a hollow cylindrical pump holder 83 housing the pump 82 therein, an upper channel 84 connected to an outlet port 82A of the pump 82, a regulator 85 disposed in the upper channel 84 for regulating the pressure of the fuel, a lower channel 86 connecting the upper channel 84 to the connection channel 67, and a plate-like bracket 87 surrounding an outer circumferential surface of the pump holder 83.

The pump 82 which is cylindrical in shape and the pump holder 83 extend vertically, and are disposed such that their axes are substantially parallel to the upstanding wall 66 and the bracket 87. The regulator 85 returns part of the fuel into the fuel tank 13 thereby by regulating the pressure of the fuel if the pressure of the fuel flowing through the upper channel 84 exceeds a prescribed pressure.

The bracket 87 is a wall including three brackets 87A, 87B, 87C held in abutment against the respective upstanding walls 66A, 66B, 66C. As with the upstanding walls 66A, 66B, 66C, the brackets 87A, 87B, 87C are arranged in a circular pattern as viewed in plan. The brackets 87A, 87B, 87C have respective lower ends contiguous to a lower portion of the pump holder 83.

The brackets 87A, 87B, 87C are disposed along inner side surfaces of the corresponding upstanding walls 66A, 66B, 66C. The bracket 87 and the upstanding wall 66, which are arranged in the circular pattern, are concentric to each other and coaxial with each other. The brackets 87A, 87B, 87C are kept within the widths of the respective upstanding walls 66A, 66B, 66C.

As shown in FIG. 3, the bracket 87 has recesses 88A, 88B, 88C defined circumferentially between the brackets 87A, 87B, 87C. An upstanding wall 89 is disposed in the recess 88B in alignment with the bracket 87.

As shown in FIG. 4, with the lower case 61 and the upper case 81 being assembled together, the lower channel 86 is connected to the connection channel 67, and the pump 82 has an inlet port 82B which is positioned near the reservoir 70. The inlet port 82B, which is defined in a lower portion of the pump 82, is supported by a stopper 68 disposed in the reservoir 70.

The lower case 61 and the upper case 81 are coupled to each other when the bracket 87 and the upstanding wall 66 engage each other, as described later.

Figure 5:
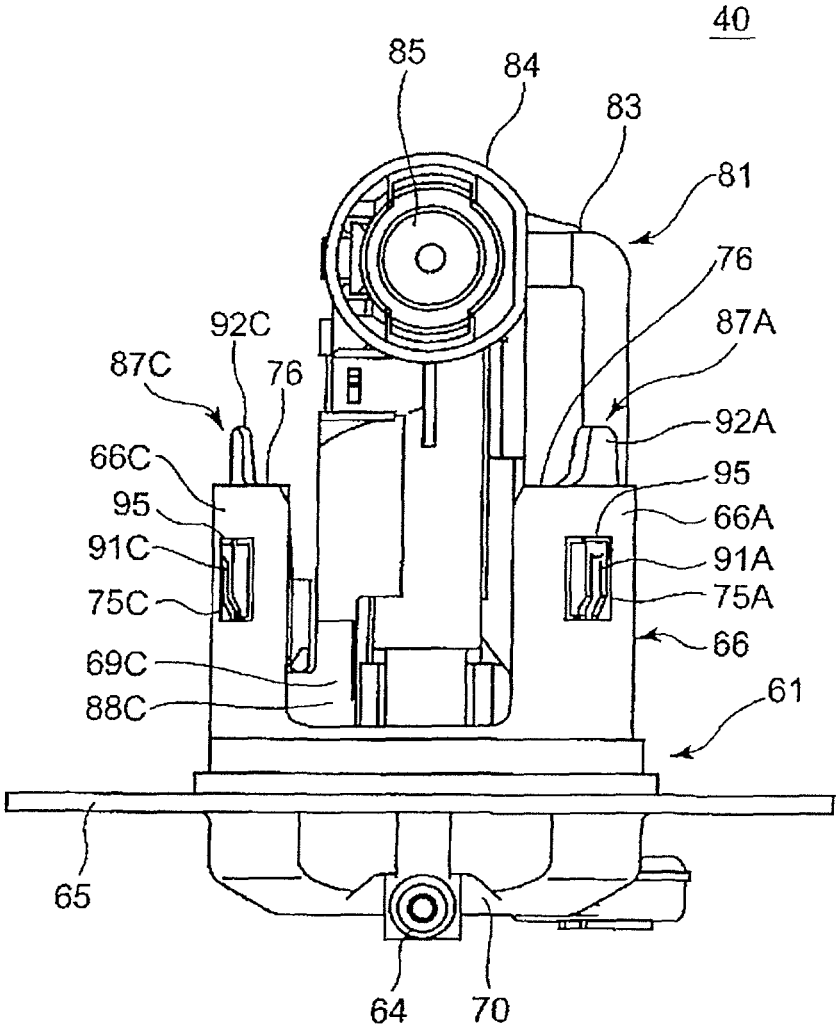
FIG. 5 is a front elevational view of the fuel pump unit as viewed from a point forward of a front side of a regulator.

FIG. 5 is a front elevational view of the fuel pump unit 40 as viewed from a point forward of a front side of the regulator 85 in FIG. 3.

As shown in FIGS. 3 and 5, the upper channel 84 extends in the forward direction of the motorcycle. In FIG. 3, the arrow Fr points in the forward direction of the motorcycle. The fuel pump unit 40 is slightly angularly displaced such that the upper channel 84 is oriented in a left forward direction of the motorcycle. With the fuel pump unit 40 being slightly angularly displaced, the upstanding wall 66B is positioned on a rear side, the upstanding wall 66A on a front left side, and the upstanding wall 66C on a front right side with respect to the motorcycle.

As shown in FIGS. 3 and 5, the recesses 69C, 88C are open in a lower portion of the upper channel 84 and have lower ends extending near the flange plate 65. The recesses 69A, 88A and the recesses 69B, 88B are positioned on rear left and right sides with respect to the motorcycle and have lower ends extending near the flange plate 65. When the level of the fuel in the fuel tank 13 is lower than the upper end of the upstanding wall 66, the fuel flows through the recesses 69C, 88C, the recesses 69A, 88A and the recesses 69B, 88B into the reservoir 70.

Therefore, the recesses 69C, 88C, the recesses 69A, 88A and the recesses 69B, 88B serve as an inlet for the fuel to flow therethrough into the reservoir 70 when the fuel in the fuel tank 13 runs low.

When the level of the fuel in the fuel tank 13 is lower than the upper end of the upstanding wall 66, the fuel flows over the upstanding wall 66 into the reservoir 70.

More specifically, when the motorcycle is accelerated, moving the remaining fuel rearwardly, as shown in FIG. 3, the fuel flows into the reservoir 70 through the recesses 69C, 88C which are open in the front side with respect to the motorcycle, and the fuel in the reservoir 70 is prevented from flowing out by the bracket 87B and the upstanding wall 66B on the rear side. Therefore, the remaining fuel is efficiently used.

When the motorcycle sways to the left or right, the fuel finds it easy to flow through the recesses 69A, 88A and the recesses 69B, 88B on the left and right sides into the reservoir 70, and the fuel in the reservoir 70 is prevented from flowing out by the bracket 87A and the upstanding wall 66A and the bracket 87C and the upstanding wall 66C. Therefore, the remaining fuel is efficiently used.

As shown in FIG. 3, the upper channel 84 has a proximal end 84A positioned centrally in the fuel pump unit 40, i.e., centrally within the bracket 87, and the pump holder 83 is joined to a side surface (left side surface) of a rear portion of the proximal end 84A adjacent to the recesses 69A, 88A. Since the pump holder 83 is disposed adjacent to the recesses 69A, 88A, large distances are maintained between the brackets 87A, 87B positioned next to the recesses 69A, 88A and the pump holder 83.

Figure 6:
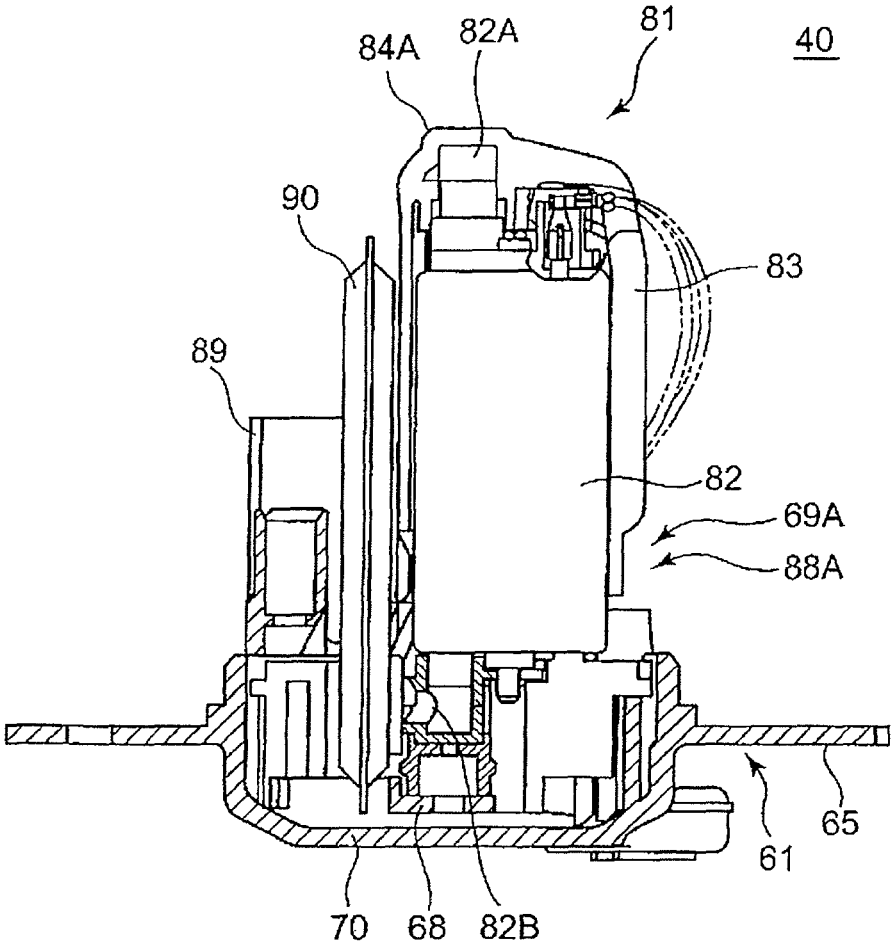
FIG. 6 is a cross-sectional view taken along line VI-VI of FIG. 3.

FIG. 6 is a cross-sectional view taken along line VI-VI of FIG. 3.

As shown in FIGS. 3 and 6, a plate-like filter 90 for trapping foreign matter in the fuel is disposed on another side surface (right side surface) of the proximal end 84A of the upper channel 84 along the pump holder 83. The filter 90 is connected to the inlet port 82B of the pump 82 and oriented substantially perpendicularly to the flange plate 65. More specifically, the filter 90 has a plate surface held against a side surface of the pump holder 83, and the bracket 87C is disposed in confronting relation to the plate surface of the filter 90. Since the bracket 87C is disposed in confronting relation to the filter 90 which is substantially perpendicular to the flange plate 65, a large distance is maintained between the bracket 87C and the filter 90.

The flow of the fuel in the fuel pump unit 40 will be described below with reference to FIGS. 4 and 6.

The fuel in the reservoir 70 is drawn through the filter 90 into the inlet port 82B of the pump 82, and discharged from the outlet port 82A into the upper channel 84. The fuel in the upper channel 84 is regulated in pressure by the regulator 85, and then supplied through the lower channel 86, the connection channel 67, the joint pipe 64, and a supply pipe (not shown) to the injector (not shown).

Figure 7:
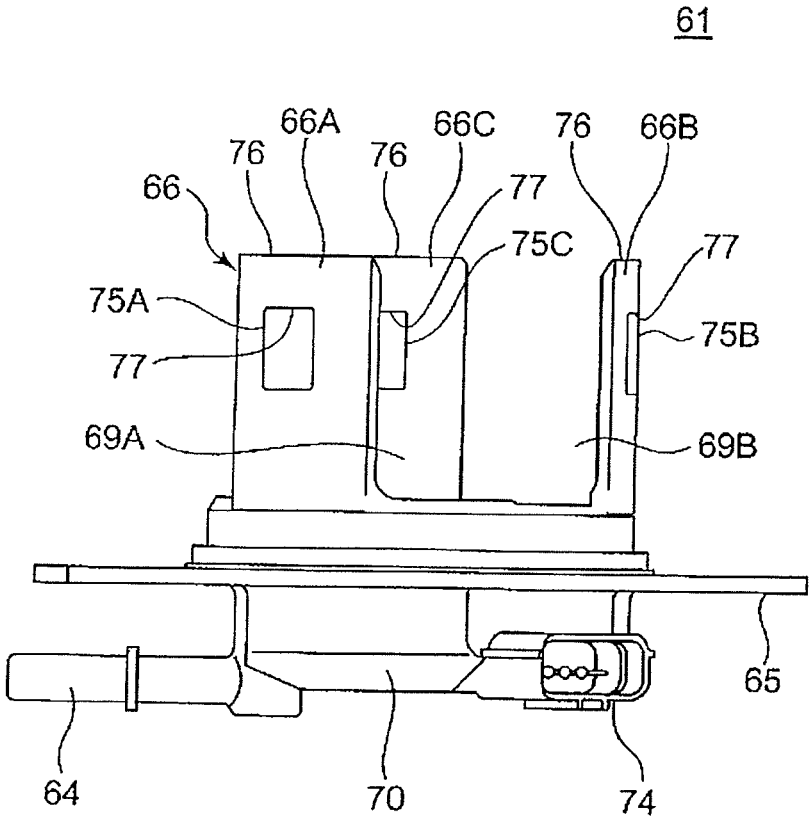
FIG. 7 is a left side elevational view of a lower case.
Figure 8:
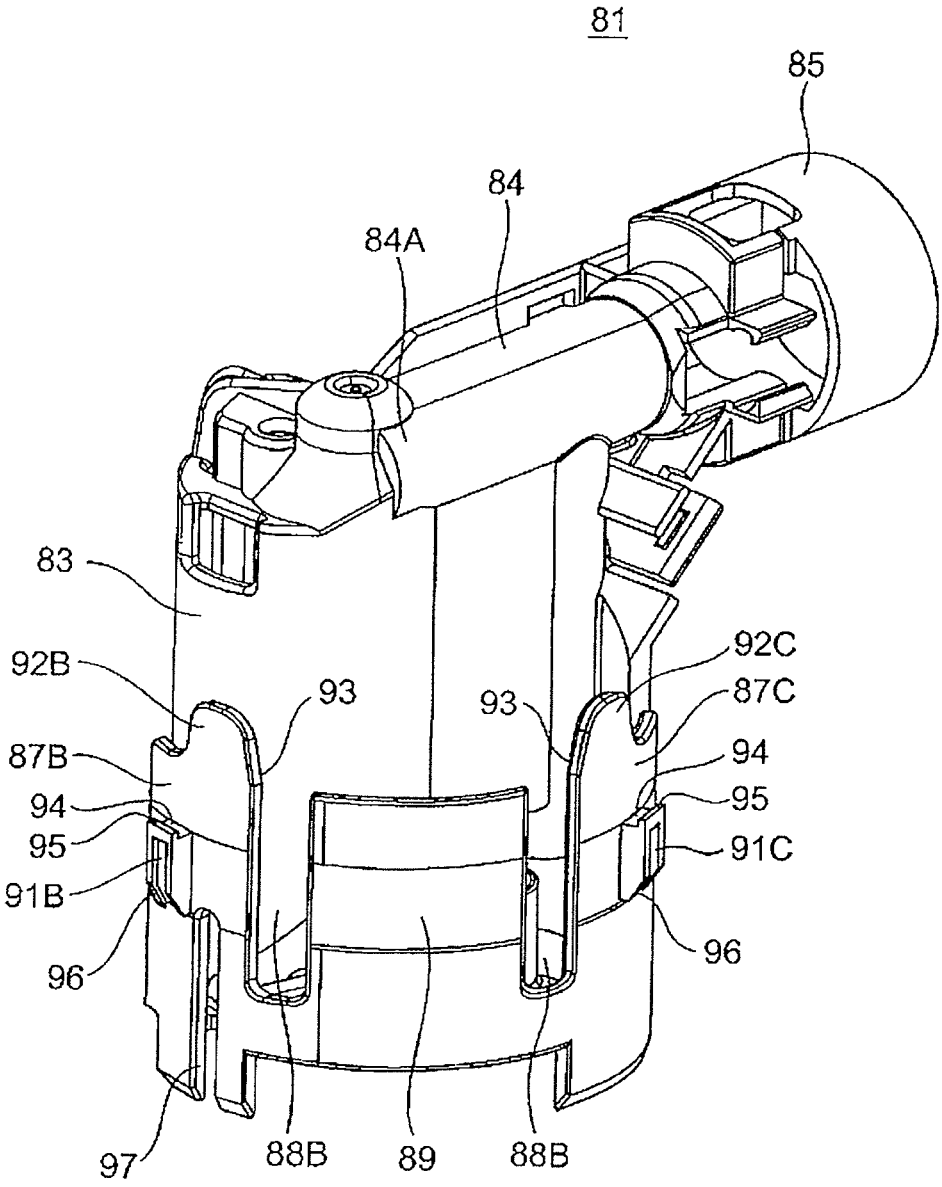
FIG. 8 is a perspective view of an upper case as viewed from a right rearward point.

FIG. 7 is a left side elevational view of the lower case 61, and FIG. 8 is a perspective view of the upper case 81 as viewed from a right rearward point.

As shown in FIG. 7, the upstanding wall 66A, 66B, 66C of the lower case 61 extend to substantially the same height, and have rectangular window-like engaging holes 75A, 75B, 75C defined respectively in upper portions thereof and extending through the upstanding wall 66A, 66B, 66C. As also shown in FIG. 3, the engaging holes 75A, 75B, 75C are positioned substantially centrally widthwise across the upstanding wall 66A, 66B, 66C, and are disposed in three locations that are angularly spaced substantially equally in the circumferential direction.

More specifically, lines S interconnecting the center G of the upstanding wall 66 at the center of the fuel pump unit 40 and the widthwise centers of the engaging holes 75A, 75B, 75C are angularly spaced substantially at 120° intervals.

As shown in FIGS. 5 and 8, the brackets 87A, 87B, 87C of the upper case 81 extend to substantially the same height, and have outwardly projecting attachment members 91A, 91B, 91C on vertically intermediate portions of outer circumferential surfaces thereof. The attachment members 91A, 91B, 91C include teeth engaging in the engaging holes 75A, 75B, 75C defined in the respective upstanding wall 66A, 66B, 66C, and extend through the engaging holes 75A, 75B, 75C from inner circumferential sides of the upstanding wall 66A, 66B, 66C.

More specifically, as shown in FIGS. 2, 3, and 5, the lower case 61 and the upper case 81 are integrally coupled to each other when the attachment members 91A, 91B, 91C engage respectively in the engaging holes 75A, 75B, 75C at the three locations.

The bracket 87B has a vertical slit 97 (see FIG. 8) defined in a lower portion thereof. The lower case 61 and the upper case 81 are circumferentially positioned by the slit 97 which is engaged by a positioning tooth (not shown) on the lower case 61.

As shown in FIGS. 5 and 8, the brackets 87A, 87B, 87C have respective tongues 92A, 92B, 92C projecting upwardly from upper ends thereof The tongues 92A, 92B, 92C serve as pressable members that will be pressed inwardly of the bracket 87 by the operator when the attachment members 91A, 91B, 91C are to disengage from the engaging holes 75A, 75B, 75C. According to the present embodiment, more specifically, when the tongues 92A, 92B, 92C are pressed, the brackets 87A, 87B, 87C are elastically deformed inwardly to cause the attachment members 91A, 91B, 91C to disengage from the engaging holes 75A, 75B, 75C.

As shown in FIGS. 4 and 5, in the assembled state, the tongues 92A, 92B, 92C project upwardly heightwise beyond upper ends 76 of the upstanding walls 66A, 66B, 66C. Therefore, in the assembled state, the tongues 92A, 92B, 92C are not covered with the upstanding walls 66A, 66B, 66C, but are exposed outwardly for being directly accessed by the operator.

The tongues 92A, 92B, 92C are disposed on circumferential ends of the respective brackets 87A, 87B, 87C. Consequently, there are no irregularities or edges in boundaries 93 (see FIG. 8) between the tongues 92A, 92B, 92C on the circumferential ends and the brackets 87A, 87B, 87C.

On the respective brackets 87A, 87B, 87C, the tongues 92A, 92B, 92C and the attachment members 91A, 91B, 91C are circumferentially offset with respect to each other. As shown in FIG. 3, the tongues 92A, 92B, 92C are positioned out of alignment with the lines S.

More specifically, the tongues 92A, 92B, 92C are circumferentially offset to provide large distances from members that are positioned inwardly of the brackets 87A, 87B, 87C. More specifically, the tongue 92A is rearwardly offset to provide a distance from the upper channel 84, the tongue 92B is offset away from the pump holder 83 to provide a distance from the pump holder 83, and the tongue 92C is rearwardly offset to provide a distance from the filter 90. Accordingly, the tongues 92A, 92B, 92C can be pressed a large stroke inwardly.

Since the tongues 92A, 92B, 92C and the attachment members 91A, 91B, 91C are circumferentially offset with respect to each other, the distances between the tongues 92A, 92B, 92C and the attachment members 91A, 91B, 91C are so large that any forces required to press the tongues 92A, 92B, 92C are small. Thus, the tongues 92A, 92B, 92C can be pressed a large stroke inwardly.

As shown in FIG. 8, the attachment members 91A, 91B, 91C have upper surfaces 94 held against upper edges 77 (see FIG. 7) of the engaging holes 75A, 75B, 75C, and upwardly projecting teeth 95 disposed on respective outer ends of the upper surfaces 94. The attachment members 91A, 91B, 91C have respective lower portions including slanted surfaces 96 which make the attachment members 91A, 91B, 91C progressively thinner downwardly. In the assembled state, the teeth 95 are positioned outside of the engaging holes 75A, 75B, 75C and engage outer circumferential surfaces of the upstanding walls 66A, 66B, 66C near the upper edges 77. Since the teeth 95 engage the outer circumferential surfaces of the upstanding walls 66A, 66B, 66C, the attachment members 91A, 91B, 91C will not disengage from the engaging holes 75A, 75B, 75C unless large forces of some degree are applied thereto, and hence are prevented from disengaging from the engaging holes 75A, 75B, 75C by vibrations or the like.

A process of assembling and disassembling the lower case 61 and the upper case 81 will be described below.

For assembling the lower case 61 and the upper case 81, the lower case 61 and the upper case 81 are circumferentially positioned with respect to each other, and then the brackets 87A, 87B, 87C of the upper case 81 are inserted into the upstanding wall 66A, 66B, 66C of the lower case 61, and the attachment members 91A, 91B, 91C are caused to engage in the engaging holes 75A, 75B, 75C. At this time, since the slanted surfaces 96 of the attachment members 91A, 91B, 91C abut against the inner circumferential surfaces of the upstanding wall 66A, 66B, 66C and spread the upstanding wall 66A, 66B, 66C, the attachment members 91A, 91B, 91C easily engage in the engaging holes 75A, 75B, 75C. As the operator can simply cause the attachment members 91A, 91B, 91C to engage in the engaging holes 75A, 75B, 75C by gripping and spreading the tongues 92A, 92B, 92C outwardly, the fuel pump unit 40 is highly maintainable.

For disassembling the lower case 61 and the upper case 81, the operator manually presses the tongues 92A, 92B, 92C into the bracket 87. The brackets 87A, 87B, 87C are caused to flex inwardly about their lower ends. The attachment members 91A, 91B, 91C are also moved inwardly to disengage from the engaging holes 75A, 75B, 75C. At this time, the attachment members 91A, 91B, 91C may disengage from the engaging holes 75A, 75B, 75C one at a time. More specifically, for example, the operator presses the tongue 92C to cause the attachment member 91C to disengage from the engaging hole 75C. Inasmuch as the tooth 95 of the attachment member 91C abuts against the inner circumferential surface of the upstanding wall 66C, the attachment member 91C which has already disengaged from the engaging hole 75C is prevented from engaging back into the engaging hole 75C.

Then, the operator presses the tongues 92A, 92B successively to cause the attachment members 91A, 91B to disengage from the engaging holes 75A, 75B. Therefore, it is neither necessary to cause the attachment members 91A, 91B, 91C to disengage from the engaging holes 75A, 75B, 75C simultaneously at the three locations, nor necessary to keep the tongues 92A, 92B, 92C pressed to hold the attachment members 91A, 91B, 91C disengaging from the engaging holes 75A, 75B, 75C. Accordingly, the fuel pump unit 40 is highly maintainable.

After the attachment members 91A, 91B, 91C have disengaged from the engaging holes 75A, 75B, 75C at the three locations, the operator can separate the upper case 81 from the lower case 61 by pulling the upper case 81 from the lower case 61. Thereafter, the operator can service the filter 90 and the pump 82 for maintenance.

Since there are no irregularities or edges in the boundaries 93 of the brackets 87A, 87B, 87C, no irregularities or edges will interfere with the above processes, making the fuel pump unit 40 highly maintainable.

According to the embodiment of the present invention, as described above, since the brackets 87A, 87B, 87C of the upper case 81 have the tongues 92A, 92B, 92C which project heightwise beyond the upstanding walls 66A, 66B, 66C of the lower case 61, the brackets 87A, 87B, 87C disposed along the inner sides of the upstanding wall 66A, 66B, 66C can easily be deformed inwardly by pressing the tongues 92A, 92B, 92C. Thus, the attachment members 91A, 91B, 91C are caused to disengage from the engaging holes 75A, 75B, 75C. Consequently, the attachment members 91A, 91B, 91C can disengage from the engaging holes 75A, 75B, 75C simply by pressing the tongues 92A, 92B, 92C inwardly without the need for a tool such as a screwdriver, so that the maintainability of the fuel pump unit 40 is increased.

Furthermore, since the attachment members 91A, 91B, 91C and the tongues 92A, 92B, 92C are circumferentially offset with respect to each other, and large distances are maintained between the attachment members 91A, 91B, 91C and the tongues 92A, 92B, 92C, the tongues 92A, 92B, 92C can be pressed a large stroke, allowing the attachment members 91A, 91B, 91C to disengage easily from the engaging holes 75A, 75B, 75C. Therefore, the fuel pump unit 40 is highly maintainable.

The filter 90 is disposed inwardly of the bracket 87C perpendicularly to the flange plate 65, and the tongue 92C is disposed in confronting relation to the filter 90, keeping a large distance between the bracket 87C and the filter 90. Therefore, when the tongue 92C is pressed, the bracket 87C is deformed a large stroke, allowing the attachment members 91A, 91B, 91C to disengage easily from the engaging holes 75A, 75B, 75C. Therefore, the fuel pump unit 40 is highly maintainable.

The tongues 92A, 92B, 92C are disposed on the circumferential ends of the brackets 87A, 87B, 87C. Consequently, there are no irregularities or edges in the boundaries 93 between the tongues 92A, 92B, 92C and the brackets 87A, 87B, 87C. Therefore, the lower case 61 and the upper case 81 can be assembled and disassembled easily and efficiently.

The engaging holes 75A, 75B, 75C are disposed at three locations that are spaced at equal intervals. Therefore, the engaging holes 75A, 75B, 75C are well balanced in position, and the lower case 61 and the upper case 81 can be assembled and disassembled easily and efficiently.

The above embodiment represents one form to which the present invention is applied, and the present invention is not limited to the above embodiment.

In the above embodiment, the lower case 61 and the upper case 81 are coupled to each other when the attachment members 91A, 91B, 91C engage in the engaging holes 75A, 75B, 75C at three locations. The present invention is not limited to such a structure. The number of engaging holes and attachment members may be changed. For example, two sets of upstanding walls and brackets that are disposed in confronting relation to each other across the pump holder 83 may have engaging holes, attachment members, and tongues, and may engage each other at two locations.

In the above embodiment, one tongue 92C is disposed in confronting relation to the filter 90. However, at least one tongue may confront the filter, and a pair of upstanding walls and brackets having engaging holes and attachment members may be disposed near the filter 90, and the brackets may have tongues confronting the filter 90.

In the above embodiment, the engaging holes 75A, 75B, 75C extend through the upstanding wall 66A, 66B, 66C. However, the engaging holes may not extend through the upstanding wall insofar as the attachment members can engage in the engaging holes. The details of motorcycle 100 may be changed as desired.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel supply apparatus comprising:

a lower case having a plate fixed to a fuel tank and upstanding walls extending into said fuel tank; and an upper case housing a fuel pump therein and having brackets disposed along inner sides of said upstanding walls;

said upstanding walls having engaging holes defined therein, and said brackets having attachment members engaging in said engaging holes;

wherein said brackets have tongues projecting heightwise beyond said upstanding walls and said brackets and said upstanding walls are disposed concentrically with each other, and said attachment members and said tongues are circumferentially offset with respect to each other.

2. The fuel supply apparatus according to claim 1, wherein a filter is disposed within said brackets perpendicularly to said plate, and at least one of said tongues is disposed in confronting relation to said filter.

3. The fuel supply apparatus according to claim 2, wherein said tongues are disposed on circumferential ends of said brackets.

4. The fuel supply apparatus according to claim 2, wherein said engaging holes comprise three engaging holes spaced at substantially equal intervals.

5. The fuel supply apparatus according to claim 1, wherein said tongues are disposed on circumferential ends of said brackets.

6. The fuel supply apparatus according to claim 1, wherein said engaging holes comprise three engaging holes spaced at substantially equal intervals.

7. A fuel supply apparatus comprising:

a lower case having a plate and upstanding walls extending upwardly therefrom;

an upper case adapted to house a fuel pump therein and having brackets disposed along inner sides of said upstanding walls; and at least one of said upstanding walls and said brackets having engaging holes defined therein, and at least one of said brackets and said upstanding walls having attachment members engaging in said engaging holes;

wherein said brackets have tongues projecting heightwise beyond said upstanding walls and said brackets and said upstanding walls are disposed concentrically with each other, and said attachment members and said tongues are circumferentially offset with respect to each other.

8. The fuel supply apparatus according to claim 7, wherein a filter is disposed within said brackets perpendicularly to said plate, and at least one of said tongues is disposed in confronting relation to said filter.

9. The fuel supply apparatus according to claim 8, wherein said tongues are disposed on circumferential ends of said brackets.

10. The fuel supply apparatus according to claim 8, wherein said engaging holes comprise three engaging holes spaced at substantially equal intervals.

11. The fuel supply apparatus according to claim 7, wherein said tongues are disposed on circumferential ends of said brackets.

12. The fuel supply apparatus according to claim 7, wherein said engaging holes comprise three engaging holes spaced at substantially equal intervals.

* * * * *